US007293324B2

(12) United States Patent
Chui et al.

(10) Patent No.: US 7,293,324 B2
(45) Date of Patent: Nov. 13, 2007

(54) VACUUM CLEANER WITH LEVEL CONTROL

(75) Inventors: Kam Lun Chui, Hong Kong (CN); Sai Kei Wong, Hong Kong (CN); Kam Hoi Ma, Hong Kong (CN); Simon P. Griffiths, Hong Kong (CN)

(73) Assignee: Techtronic Industries Co., Ltd., New Territories (HK)

( * ) Notice: Subject to any disclaimer, the term of this patent is extended or adjusted under 35 U.S.C. 154(b) by 600 days.

(21) Appl. No.: 10/665,544

(22) Filed: Sep. 19, 2003

(65) Prior Publication Data

US 2005/0060832 A1 Mar. 24, 2005

(51) Int. Cl.
*A47L 9/00* (2006.01)

(52) U.S. Cl. ..... 15/353; 15/319

(58) Field of Classification Search ..... 15/353, 15/319; 96/408, 409; 55/418, 447, 467, 55/DIG. 3

See application file for complete search history.

(56) References Cited

U.S. PATENT DOCUMENTS

| | | | | | |
|---|---|---|---|---|---|
| 3,543,325 | A | * | 12/1970 | Hamrick | 15/314 |
| 3,605,786 | A | | 9/1971 | Machin, Jr. | |
| 3,618,297 | A | * | 11/1971 | Hamrick | 96/406 |
| 3,870,486 | A | | 3/1975 | Eriksson | 96/385 |
| 3,921,250 | A | * | 11/1975 | Jerabek | 15/353 |
| 4,041,569 | A | | 8/1977 | Petersen et al. | |
| 4,172,710 | A | * | 10/1979 | van der Molen | 15/353 |
| 4,246,676 | A | | 1/1981 | Hallsworth et al. | |
| 4,275,731 | A | * | 6/1981 | Nichols | 604/319 |
| 4,776,060 | A | | 10/1988 | Chang | 15/339 |
| 5,078,761 | A | | 1/1992 | Dyson | 96/400 |
| 5,201,095 | A | * | 4/1993 | Choi | 15/339 |
| 5,815,881 | A | | 10/1998 | Sjogreen | 15/321 |
| 6,026,540 | A | * | 2/2000 | Wright et al. | 15/353 |
| 6,049,940 | A | * | 4/2000 | Robitaille | 15/319 |
| 6,146,434 | A | * | 11/2000 | Scalfani et al. | 55/334 |
| 6,237,186 | B1 | * | 5/2001 | Griffiths | 55/334 |
| 6,269,518 | B1 | * | 8/2001 | Yung | 15/352 |
| 6,347,430 | B1 | | 2/2002 | Buss et al. | |
| 6,524,358 | B2 | * | 2/2003 | Yang | 55/337 |

FOREIGN PATENT DOCUMENTS

| | | |
|---|---|---|
| CA | 2260428 | 7/2000 |
| WO | WO99/19045 | 4/1999 |

* cited by examiner

*Primary Examiner*—Theresa T. Snider
(74) *Attorney, Agent, or Firm*—Brinks Hofer Gilson & Lione

(57) ABSTRACT

A vacuum cleaner has a housing that includes a separation chamber and collection chamber, a floor unit with a suction opening, and a passage between the suction opening and separation chamber. A suction source establishes a stream of air from the suction opening to the separation chamber for separation of liquids and contaminants. A controller stops the suction source when a level of liquid in the collection chamber rises to a predetermined level. There is a protective structure to shield at least a portion of the controller from circular movement of the liquid in the collection chamber. A structure in the separation chamber defines a path for the stream of air along an internal perimeter of the separation chamber.

16 Claims, 5 Drawing Sheets

VACUUM CLEANER WITH LEVEL CONTROL

BACKGROUND TO THE INVENTION

1. Field of the Invention

The invention relates to vacuum cleaners, and in particular to wet/dry vacuum cleaners. The invention also relates to so-called cyclonic vacuum cleaners which use a circulating airflow to separate contaminants from the air.

2. Background Information

Wet/dry vacuum cleaners are well-known. Such vacuum cleaners separate liquid and contaminants from a suction stream of air. The liquid and contaminants are collected in a collection chamber for later emptying. It is also known to put a level switch, such as a float switch, in the collection chamber to stop the vacuum cleaner motor when a level of liquid in the collection chamber rises to a predetermined level.

Cyclonic vacuum cleaners that use circular airflow within a separation chamber to separate liquid and contaminants from a stream of air are also known. Typically, a separation chamber is provided in an upper portion of a cyclone housing, with the lower portion of the housing forming a collection chamber for the separated liquid and contaminants. The circular airflow causes circular movement of water in the collection chamber. A problem with placing a level switch within the collection chamber of a cyclone vacuum cleaner is that the circular movement of water in the collection chamber results in inaccurate level measurement.

A second problem is that it is difficult to get a stream of air laden with heavy water to move in a circular motion within the separation chamber in order to separate the liquid and contaminants from the air stream.

SUMMARY OF THE INVENTION

It is an object of the present invention to provide a cyclone vacuum cleaner with improved liquid level measurement. It is a further object of the present invention to provide a cyclonic wet/dry vacuum cleaner with improved circular airflow for separation of liquid and contaminants from the stream of air. It is a final object of the present invention to provide a vacuum cleaner which at least overcomes problems with known vacuum cleaners or provides the public with a useful alternative.

According to a first aspect of the invention there is provided a vacuum cleaner comprising: a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a controller for stopping the suction source when a level of liquid in the collection chamber rises to a predetermined level, and a protective structure to shield at least a portion of the controller from circular movement of the liquid.

Preferably, the controller is a float and a switch.

Preferably, the protective structure is a float guide for constraining the float therein.

Preferably, an upstream wall of the float guide is solid for defecting the circular movement of the liquid, and a downstream wall of the float guide has a opening for allowing a liquid level in the float guide to rise with the level of liquid in the collection chamber.

Preferably, the switch is positioned on an outside wall of the collection chamber, and a lever is positioned through an opening in the wall for activating the switch.

Preferably, the float has a rod for engaging the lever.

Preferably, the float guide is a tube with openings at a top and bottom thereof.

According to a second aspect of the invention there is a provided a vacuum cleaner comprising: a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a float arranged to rise when a level of liquid in the collection chamber rises, a protective structure for constraining the float therein and having an upstream wall for deflecting circular movement of the liquid, a switch positioned on an outside wall of the collection chamber and for stopping the suction source, and a lever positioned through an opening in the wall for activating the switch when the level of liquid rises to a predetermined level.

According to a third aspect of the invention there is provided a vacuum cleaner comprising: a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, and a structure for defining a path for the stream of air along an internal perimeter of the separation chamber.

Preferably, the structure is a cylindrical wall positioned within the separation chamber.

Preferably, an air inlet of the separation chamber defines an inlet path for the stream of air that is tangential to the path along the internal perimeter of the separation chamber.

Preferably, the air inlet has a restriction for increasing a velocity of the stream of air within the separation chamber.

Preferably, the vacuum cleaner further includes a float arranged to rise when a level of liquid in the collection chamber rises, a protective structure for constraining the float therein and having an upstream wall for deflecting circular movement of the liquid, a switch positioned on an outside wall of the collection chamber and arranged for stopping the suction source, and a lever positioned through an opening in the wall for activating the switch when the level of liquid rises to a predetermined level.

According to a forth aspect of the invention there is provided a vacuum cleaner comprising: a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a structure for defining a path for the stream of air along an internal perimeter of the separation chamber, a controller for stopping the suction source when a level of liquid in the collection chamber rises to a predetermined level, and a protective structure to shield at least a portion of the controller from circular movement of the liquid.

Further aspects of the invention will become apparent from the following description, which is given by way of example only.

BRIEF DESCRIPTION OF THE DRAWINGS

An embodiment of the invention will now be described by way of example only and with reference to the accompanying drawing, in which.

DESCRIPTION OF THE PREFERRED EMBODIMENT

Figure 1:
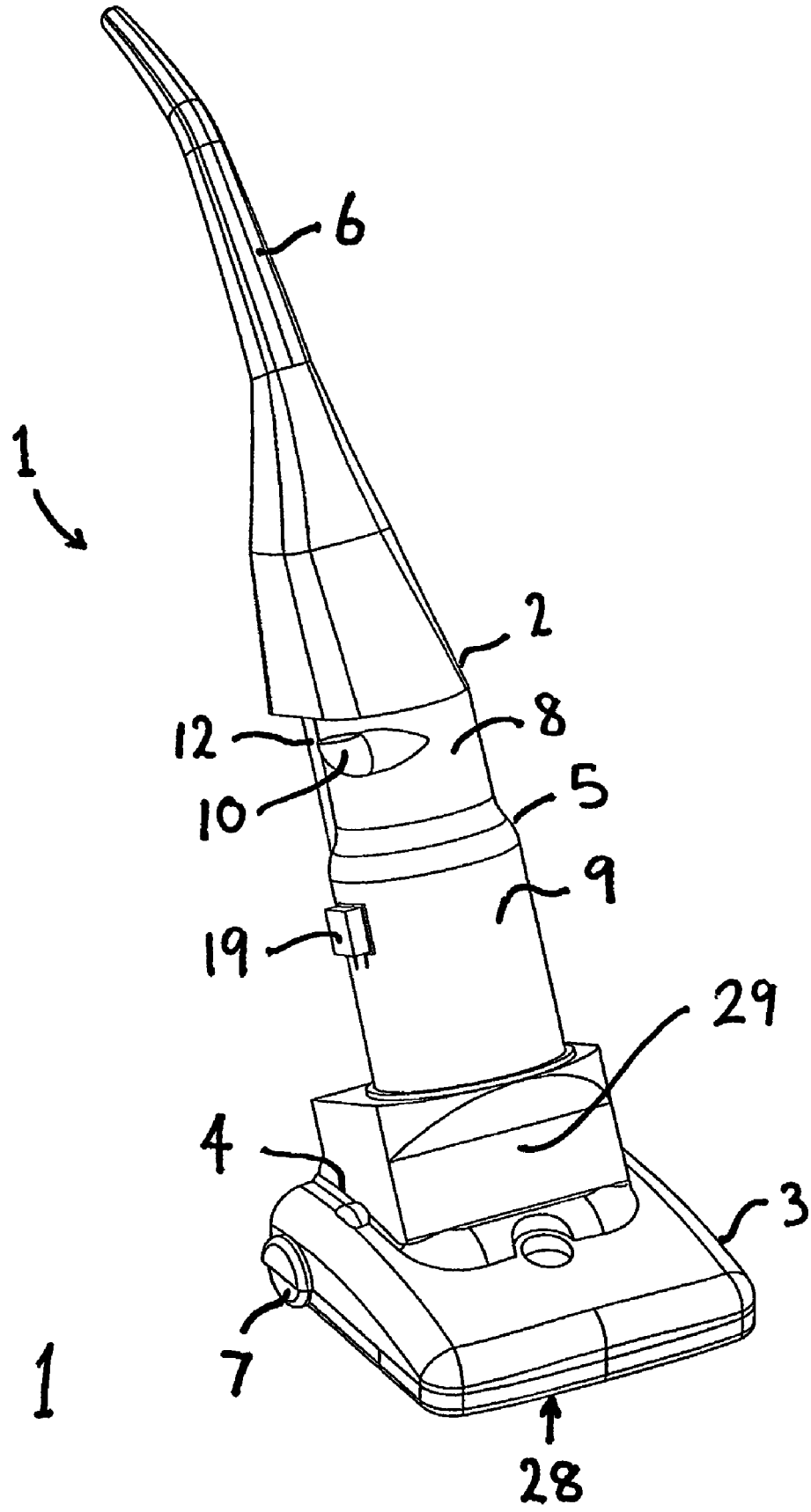
FIG. 1 is a perspective view of an upright vacuum cleaner.
Figure 3:
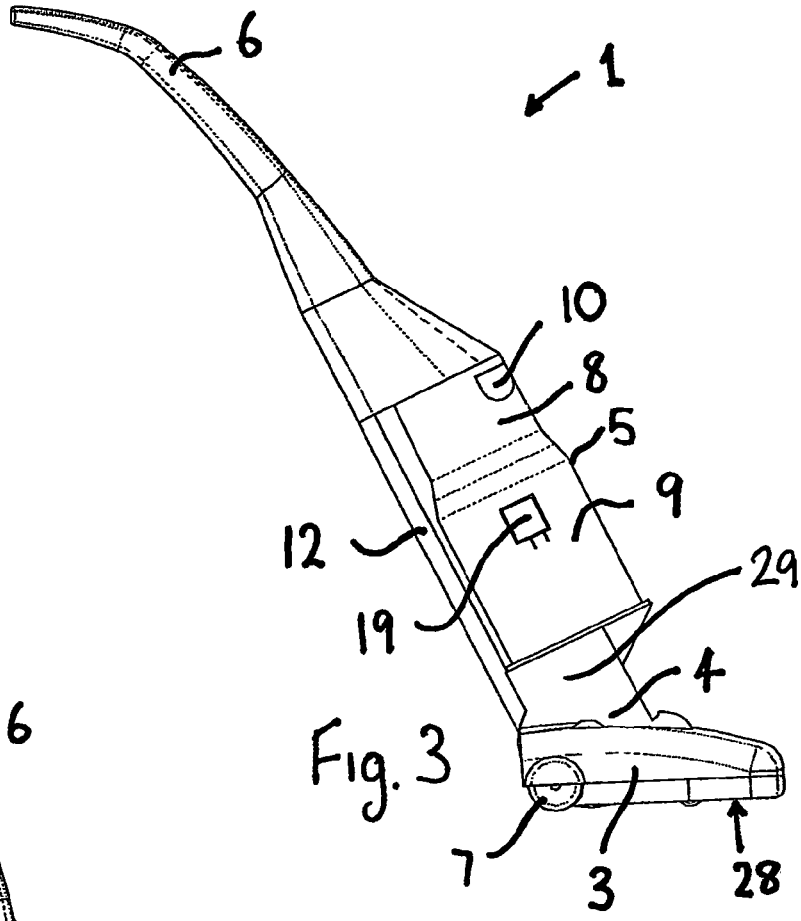
FIG. 3 is a side view of the vacuum cleaner in an operating position.
Figure 2:
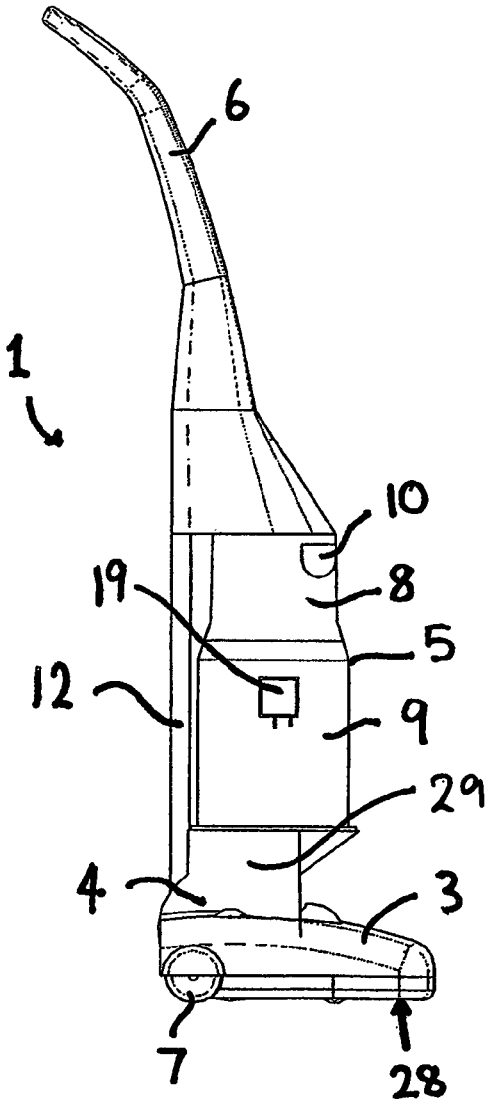
FIG. 2 is a side view of the upright vacuum cleaner.

Referring to FIG. 1, a vacuum cleaner 1 has an upright unit 2 and a floor unit 3 joined at a pivot position 4. The upright unit 2 includes a cyclone housing 5 that defines an upper separation chamber 8 for separating liquid and contaminants from an air stream and a lower collection chamber 9 for collecting the separated liquid and contaminants. At the distal end of upper unit 2 is a handle 6.

The floor unit 3 has wheels 7 for travelling along a floor surface. On the underside of floor unit 3 is a suction opening 28 through which liquid and contaminants are drawn in with a stream of air. The stream of air, with liquid and contaminants, travels through a passage 12 to an inlet 10 of the separation chamber 8. Located at the base of upright unit 2 is a suction motor 29 for establishing and maintaining the stream of air from the suction opening 28 through passage 12 to the inlet 10 of separation chamber 8.

Figure 4:
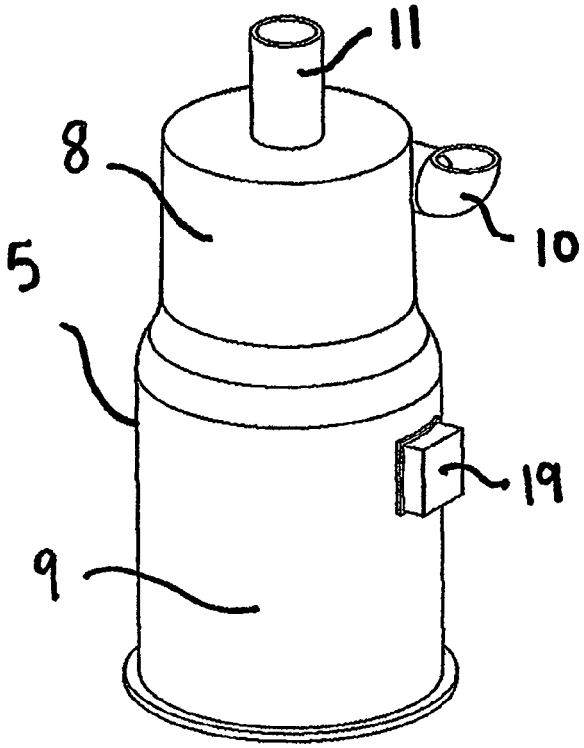
FIG. 4 is an illustration of a cyclone housing for the vacuum cleaner.
Figure 5:
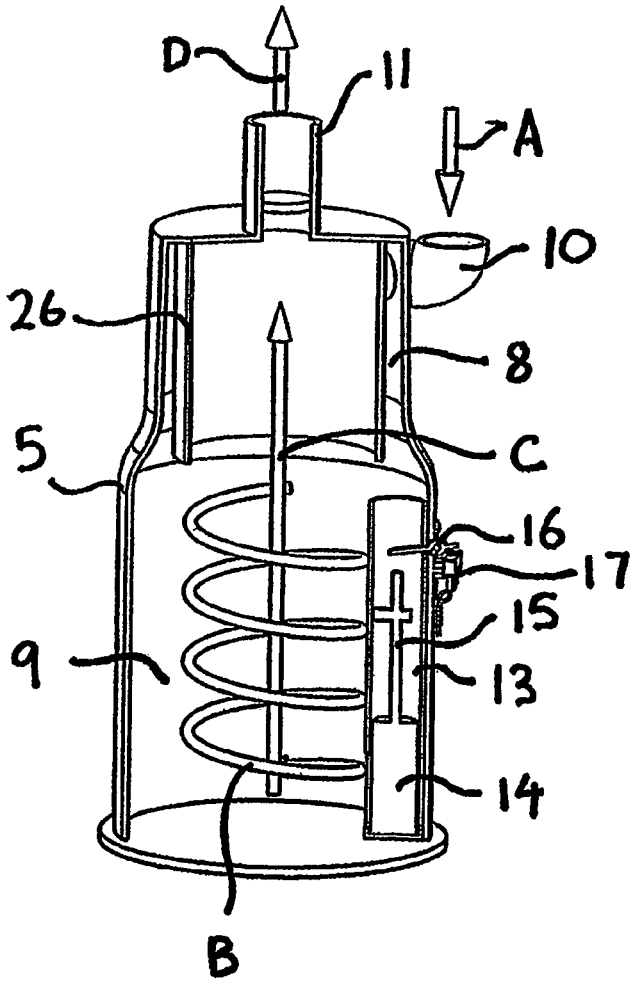
FIG. 5 is a section view of through the cyclone housing.
Figure 6:
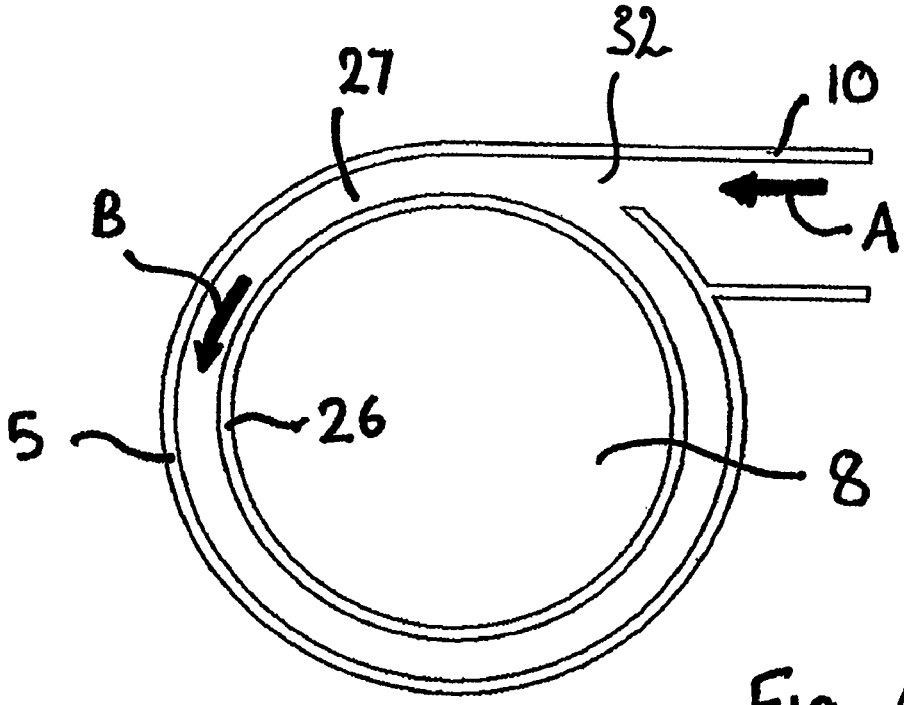
FIG. 6 illustrates a structure for facilitating circular airflow in the separation chamber.
Figure 8:
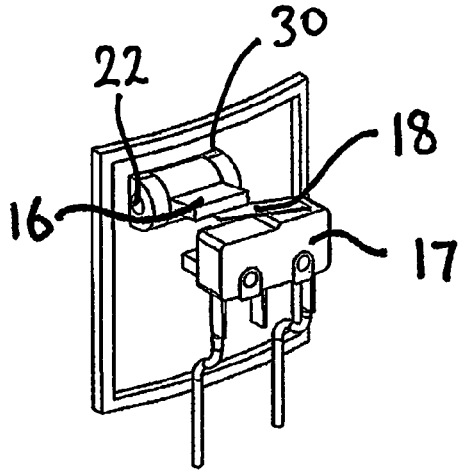
FIG. 8 is a switch for stopping the suction motor of the vacuum cleaner.
Figure 9:
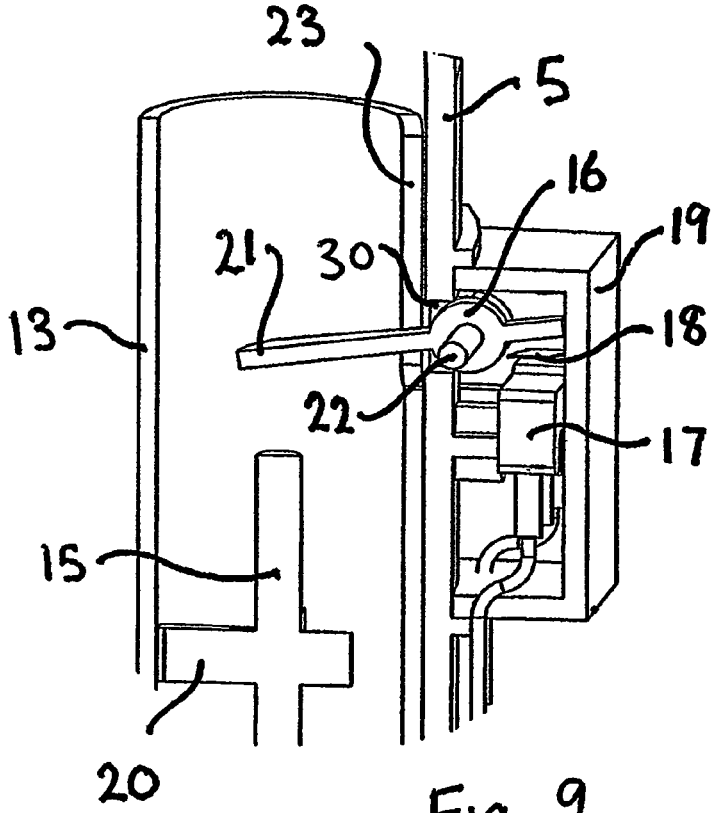
FIG. 9 illustrates operation of the switch.
Figure 10:
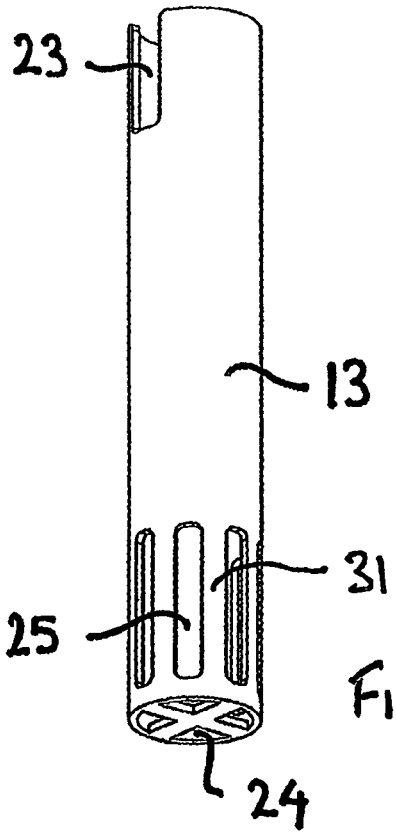
FIG. 10 is a float guide for the collection chamber of the vacuum cleaner.

Referring FIGS. 4 to 6, cyclone housing 5 is a substantially cylindrical shaped hollow body. The upper portion of housing 5 defining the separation chamber 8 has a smaller diameter than the lower portion defining the collection chamber 9. Within the separation chamber 8 is a cylindrical wall 26 that defines an air stream path 27 around the internal perimeter of the separation chamber 8. The air inlet 10 is provided in a circumferential wall of the separation chamber 8 and defines an inlet air stream path tangential to the internal perimeter of separation chamber 8. The opening 32 of air inlet 10 is smaller than then passage 12 to restrict the stream of air entering the separation chamber 8. An air outlet 11, which is connected through to the suction motor 29, exits the separation chamber 8 through the top of housing 5 along its axial center.

The stream of air, containing liquid and contaminants, enters the suction chamber inlet 10 as indicating by arrow A. The velocity of the stream of air increases as it enters air stream path 27 through the restriction of smaller opening 32. The stream of air travels around the airflow path 27 created by cylindrical wall 26 as indicated by arrow B. This sets up a circulating airflow for separating liquid and contaminants from the steam of air. The higher velocity of the stream of air within separation chamber 8 increases separation performance. The circulating stream of air spirals downwards within the cyclonic housing 5 to the collection chamber 9 as indicated by path B. The stream of air then travels up the axial center of the cyclonic housing 5 in the direction of arrow C and out through the outlet 11 of separation chamber 8 as indicated at arrow D.

Figure 7:
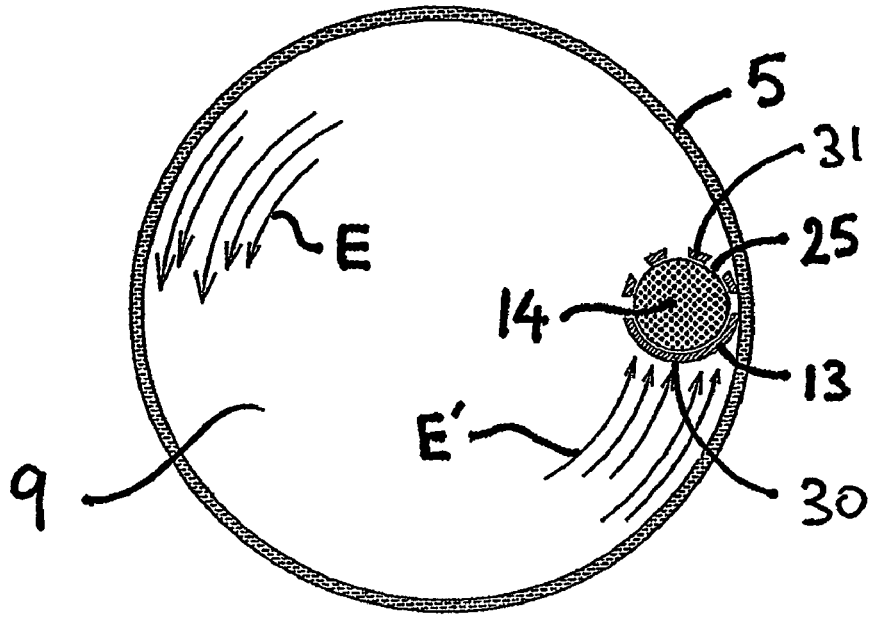
FIG. 7 illustrates circular movement of water within the collection chamber.

During the circular movement of the stream of air in direction B liquid and contaminants are separated from the stream and collect in the bottom of collection chamber 9. As more liquid and contaminants are separated from the stream of air a level of liquid in the collection chamber 9 rises. Due to the circular movement of the stream of air within cyclone housing 5 the liquid in collection chamber 9 moves around the chamber in a circular direction as indicated by arrows E in FIG. 7.

Positioned within separation chamber 9, and against an internal wall thereof, is a float guide 13 in the form of a tube. Positioned within float guide 13 is a buoyant float 14. The float has an upwardly extending rod 15. Extending radially from the rod proximate its top end are guide arms 20 which contact the interior wall of float guide 13 for supporting the upper end of rod 15.

Located on the exterior wall of the housing 5 proximate the top of collection chamber 9 is a switch 17. The switch 17 is arranged to stop the suction motor 29 when it is operated. A cover 19 is provided over the switch 17 to stop dust and dirt interfering with its operation, and to prevent contact with electrical parts. A lever 16 is mounted on a pivot 22 and extends through an opening 30 in the wall of cyclone housing 5 into an upper part of the float guide 13. As the level of liquid in the collection chamber 9 rises so does float 14. When a predetermined level of liquid is reached the top of rod 15 engages with an end 21 of lever 16 causing it to pivot and depress operating lever 18 of switch 17. When the switch 17 is operated it stops suction motor 29 to prevent overflow of liquid the collection chamber 9.

The float guide 13 protects the float from the circular movement of the liquid in collection chamber 9. The hemispherical portion 31 of the float guide wall which faces upstream towards circular flow E of the liquid is solid to deflect the circular movement of the liquid away from the float 14. The hemispherical portion 31 of the wall which is facing downstream of the circular liquid flow E has a plurality of elongate openings 25 which allow the inlet of water to the float guide 13 so that the level of liquid in the float guide 13 rises with the level of liquid in the separation chamber 9. The bottom end of the float guide 13 also has a plurality of openings 24. A slot 23 extends longitudinally along the float guide wall from its open top end. Slot 23 is positioned adjacent opening 30 in the housing wall so that lever 16 extends into the float guide 13.

Where in the foregoing description reference has been made to integers or elements have known equivalents then such are included as if individually set forth herein.

Embodiments of the invention having been described, however it is understood that variations, improvements or modifications can take place without departure from the spirit of the invention or scope of the appended claims.

What is claimed is:

1. A vacuum cleaner comprising:

a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a controller for stopping the suction source when a level of liquid in the collection chamber rises to a predetermined level, and a protective structure within the collection chamber and at least partially surrounding at least a portion of the controller.

2. The vacuum cleaner of claim 1 wherein the controller is a float and a switch.

3. The vacuum cleaner of claim 1 wherein the protective structure is a float guide for constraining a float therein.

4. The vacuum cleaner of claim 3 wherein an upstream wall of the float guide is solid for deflecting the circular movement of the liquid, and a downstream wall of the float guide has an opening for allowing a liquid level in the float guide to rise with the level of liquid in the collection chamber.

5. The vacuum cleaner of claim 2 wherein the switch is positioned on an outside wall of the collection chamber, and a lever is positioned through an opening in the wall for activating the switch.

6. The vacuum cleaner of claim 5 wherein the float has a rod for engaging the lever.

7. The vacuum cleaner of claim 3 wherein the float guide is a tube with openings at a top and bottom thereof.

8. A vacuum cleaner comprising:

a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a float arranged to rise when a level of liquid in the collection chamber rises, a protective structure for constraining the float therein and having an upstream wall for deflecting circular movement of the liquid, a switch positioned on an outside wall of the collection chamber and for stopping the suction source, and a lever positioned through an opening in the outside wall for activating the switch when the level of liquid rises to a predetermined level.

9. A vacuum cleaner comprising:

a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, and a structure comprising a cylindrical wall positioned within the separation chamber for defining a path for the stream of air along an internal perimeter of the separation chamber;

further comprising a float arranged to rise when a level of liquid in the collection chamber rises, a protective structure for constraining the float therein and having an upstream wall for deflecting circular movement of the liquid, a switch positioned on an outside wall of the collection chamber and arranged for stopping the suction source, and a lever positioned through an opening in the outside wall for activating the switch when the level of liquid rises to a predetermined level.

10. The vacuum cleaner of claim 9 wherein an air inlet of the separation chamber defines an inlet path for the stream of air that is tangential to the path along the internal perimeter of the separation chamber.

11. The vacuum cleaner of claim 10 wherein the air inlet has a restriction for increasing a velocity of the stream of air within the separation chamber.

12. A vacuum cleaner comprising:

a housing having a separation chamber for separating liquid and contaminants from a stream of air, and a collection chamber for collecting the separated liquid and contaminants, a floor unit having a suction opening, a passage between the suction opening and separation chamber, a suction source for establishing and maintaining the stream of air from the suction opening to the separation chamber, a structure for defining a path for the stream of air along an internal perimeter of the separation chamber, a controller for stopping the suction source when a level of liquid in the collection chamber rises to a predetermined level, and a protective structure within the collection chamber and at least partially surrounding at least a portion of the controller.

13. A vacuum cleaner comprising a housing including a portion for separating liquid and contaminants from a stream of fluid and a portion for collecting the separated liquid and contaminants;

a suction opening fluidically connected to the housing;

a suction source for establishing and maintaining the stream of fluid from the suction opening to the housing;

a controller disposed on the housing for stopping the suction source when a level of liquid in the housing rises to a predetermined level; and, a protective structure at least partially surrounding at least a portion of the controller;

wherein the controller is a float and a switch that is positioned on an outside wall of the portion for collecting the separated liquids and contaminants, and a lever is positioned through an opening in the wall for activating the switch.

14. The vacuum cleaner of claim 13 wherein the protective structure is a float guide for constraining a float therein.

15. The vacuum cleaner of claim 14 wherein an upstream wall of the float guide is solid for deflecting any circular movement of the liquid, and a downstream wall of the float guide has an opening for allowing a liquid level in the float guide to rise with the level of liquid in the portion for collecting the separated liquids and contaminants.

16. The vacuum cleaner of claim 14 wherein the float guide is a tube with openings at a top and bottom thereof.

* * * * *